US009716335B2

(12) United States Patent
Shi et al.

(10) Patent No.: US 9,716,335 B2
(45) Date of Patent: Jul. 25, 2017

(54) CONNECTOR ASSEMBLY

(71) Applicant: Tyco Electronics (Shanghai) Co. Ltd., Shanghai (CN)

(72) Inventors: Ming Shi, Shanghai (CN); Hongjun Yin, Shanghai (CN); Xiang Xu, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 4 days.

(21) Appl. No.: 14/847,650

(22) Filed: Sep. 8, 2015

(65) Prior Publication Data

US 2016/0072214 A1 Mar. 10, 2016

(30) Foreign Application Priority Data

Sep. 5, 2014 (CN) ..... 2014 2 0511627 U

(51) Int. Cl.
*H01R 13/502* (2006.01)
*H01R 13/50* (2006.01)
*H01R 13/24* (2006.01)

(52) U.S. Cl.
CPC ..... *H01R 13/50* (2013.01); *H01R 13/2442* (2013.01)

(58) Field of Classification Search
CPC ..... H01R 13/50; H01R 13/2442
See application file for complete search history.

(56) References Cited

U.S. PATENT DOCUMENTS 3,011,143 A * 11/1961 Dean ..... H01R 13/28 439/291
3,960,434 A * 6/1976 Soes ..... H01R 13/02 439/660
4,552,425 A * 11/1985 Billman ..... H01R 13/113 439/295
4,963,102 A * 10/1990 Gettig ..... H01R 13/28 439/291
5,035,639 A * 7/1991 Kilpatrick ..... H01R 13/28 439/290
5,921,787 A * 7/1999 Pope ..... H01R 12/85 439/660
7,001,194 B2 * 2/2006 Yang ..... H01R 23/27 439/295
7,153,152 B1 * 12/2006 Eby ..... H01R 4/185 439/295
2010/0190385 A1 * 7/2010 Yamakami ..... H01R 13/6315 439/700

* cited by examiner

*Primary Examiner* — Briggitte R Hammond
(74) *Attorney, Agent, or Firm* — Barley Snyder

(57) ABSTRACT

A connector assembly is provided and includes a first connector and a second connector. The first connector includes a first insulation body and a first terminal with a first cantilever secured in the first insulation body. The second connector connects with the first connector and includes a second insulation body, a second terminal secured in the second insulation body, and a second cantilever positioned between the first insulation body and the first terminal.

20 Claims, 4 Drawing Sheets

CONNECTOR ASSEMBLY

CROSS-REFERENCE TO RELATED APPLICATION

This application claims the benefit of the filing date of Chinese Patent Application No. 201420511627.9 under 35 U.S.C. §119(a)-(d) filed on Sep. 5, 2014.

FIELD OF THE INVENTION

The invention relate to a connector assembly and, more particularly, to a connector assembly having a pair of connectors adapted to connect to each other.

BACKGROUND

In the prior art, known connector assembly includes a male connector and a female connector which are adapted to connect to each other. After the male connector is inserted into the female connector, a terminal in the male connector and a terminal in the female connector are elastically and electrically contacted to each other so as to achieve an electric connection between the male connector and the female connector.

In the prior art, during the insertion or extraction of the male connector into or out of the female connector, the terminal of the male connector electrically contacts the terminal of the female connector so as to create a friction fit. In the prior art, to ensure a reliable and electrical connection between the terminal of the male connector and the terminal of the female connector, it is necessary to increase the relative deformation (interference amount) between the terminal of the male connector and the terminal of the female connector. However, as both the terminal of the male connector and the terminal of the female connector are covered with coatings with a relative large friction factor, when the relative deformation between the terminal of the male connector and the terminal of the female connector are increased, excessive friction force occurs between the terminal of the male connector and the terminal of the female connector, which makes the force of inserting or extracting the male connector and the female connector become much larger. In order to reduce the insert/extract force, the relative deformation between the terminal of the male connector and the terminal of the female connector needs to be reduced, which results in decreased elastic contact force between the terminal of the male connector and the terminal of the female connector. However, as a result, the elastic and electric contact between the terminal of the male connector and the terminal of the female connector may become unreliable.

Moreover, in the prior art, the terminal of one of the male connector and the female connector suspends in the insulation body of the other one connector, then the position of the terminal cannot be controlled, which makes it difficult to control the relative deformation between the terminal of male and female connector and results in an inconstant insertion/extraction force during engaging the male and female connector.

SUMMARY

The purpose of the present disclosure is intended to solve at least one aspect of the above issues and faults in the prior art.

A connector assembly is provided and includes a first connector and a second connector. The first connector includes a first insulation body and a first terminal with a first cantilever secured in the first insulation body. The second connector connects with the first connector and includes a second insulation body, a second terminal secured in the second insulation body, and a second cantilever positioned between the first insulation body and the first terminal.

BRIEF DESCRIPTION OF THE DRAWINGS

The above and other features of the invention will become more apparent by describing in detail exemplary embodiments thereof with reference to the accompanying drawings, in which.

DETAILED DESCRIPTION OF THE EMBODIMENT(S)

Figure 1:
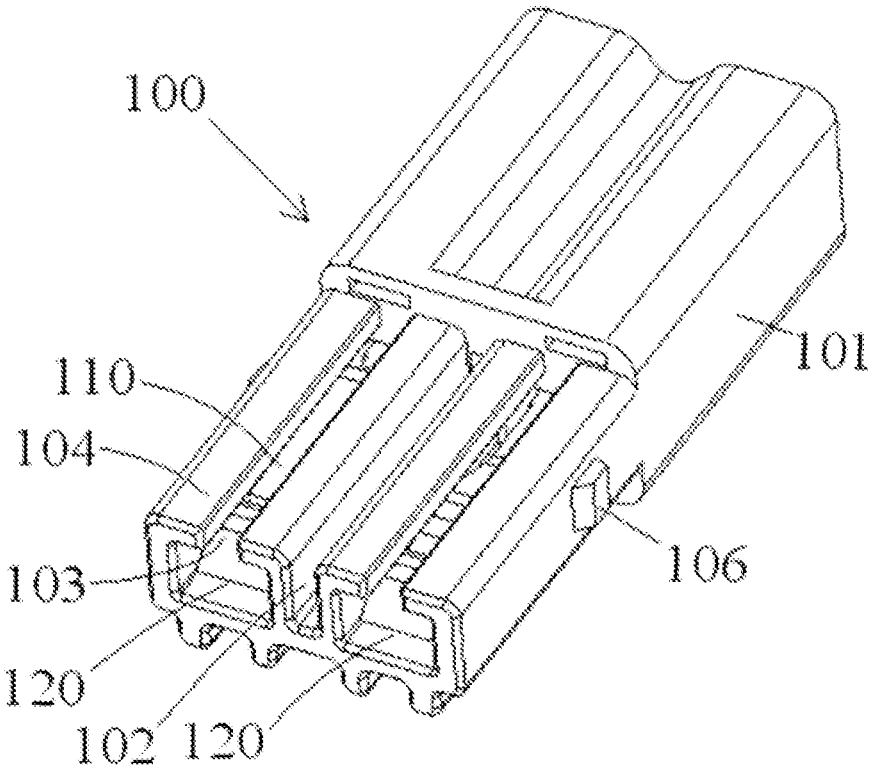
FIG. 1 is a perspective view of a first connector a connector assembly according the invention.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 8:
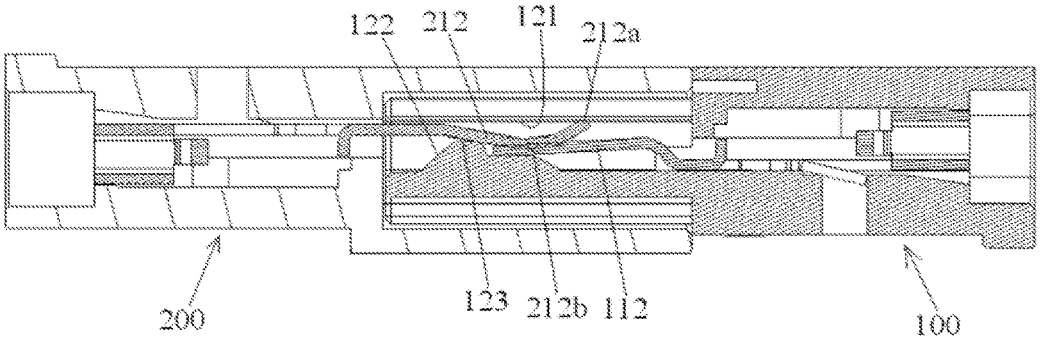
FIG. 8 is a longitudinal sectional view of a connector assembly according to invention showing a first connector and a second connector connected to each other.

According to a general concept of the present disclosure, there is provided a connector assembly, for instance, as shown in FIG. 8

As shown in FIG. 8, in an exemplary embodiment of the invention, the connector assembly includes a first connector 100 and a second connector 200 which are adapted to connect to each other.

With reference to FIG. 1, a first connector 100, according to an exemplary embodiment of the invention, is shown.

As shown in FIG. 1, the first connector 100 is a male connector having a first insulation body 101 and a first terminal 110 held in the first insulation body 101.

Figure 6:
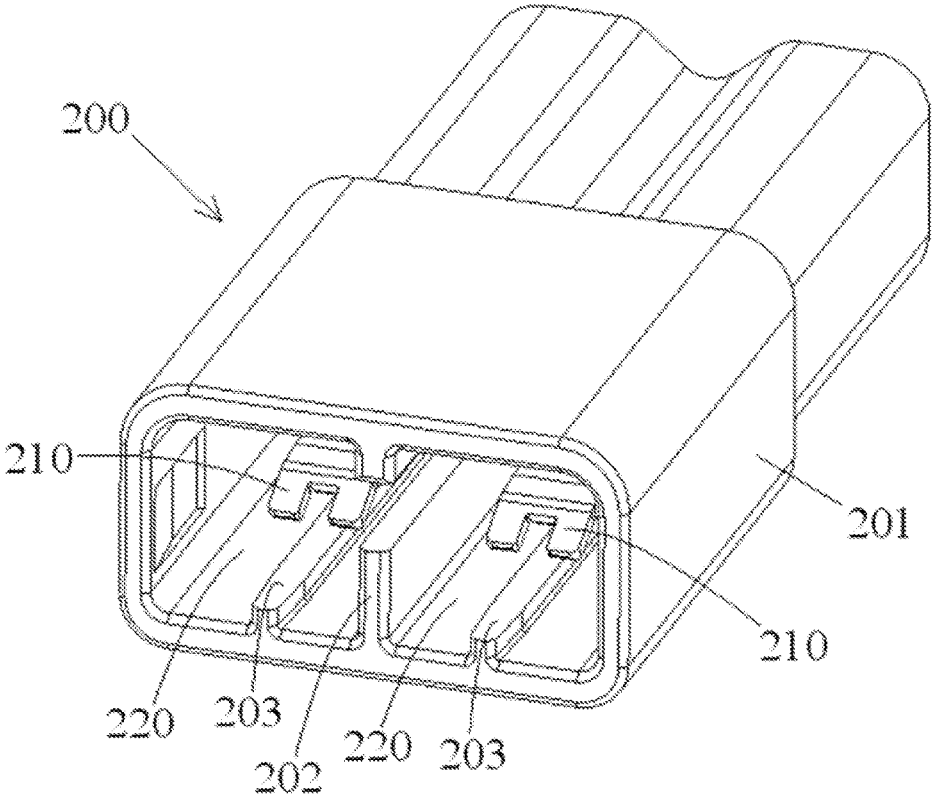
FIG. 6 is a perspective view a second connector of the connector assembly according to the invention.

With reference to FIG. 6, a second connector 200, according to an exemplary embodiment of the invention, is shown.

As shown in FIG. 6, the second connector 200 is a female connector including a second insulation body 201 and a second terminal 210 held in the second insulation body 201.

As shown in FIGS. 1, 6 and 8, after the first and second connector 100, 200 are engaged with each other, the first terminal 110 of the first connector 100 contacts the second terminal 210 of the second connector 200 elastically and electrically.

Further referring to FIG. 8, in an exemplary embodiment of the invention, during connection of the first connector 100 and second connector 200, a cantilever 212 of the second terminal 210 of the second connector 200 is pressed by an insulation body 101 of the first connector 100 and deformed elastically. After the first connector 100 and second connector 200 are engaged with each other, the cantilever 212 of the second terminal 210 of the second connector 200 is pressed between the first insulation body 101 and the first terminal 110 of the first connector 100 so as to contact the first terminal 110 of the first connector 100 elastically and electrically.

Figure 2:
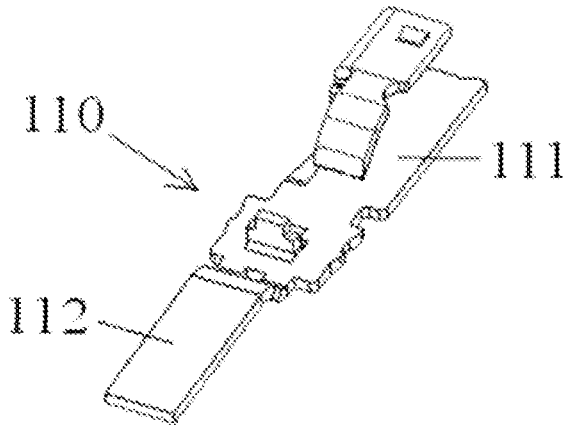
FIG. 2 is a perspective view showing a terminal of the first connector of FIG. 1.

As shown in FIGS. 1 and 2, in an exemplary embodiment of the invention, a first terminal receiving slot 120 is provided in the first insulation body 101, in which the cantilever 112 of the first terminal 110 is received. A base 111 of the first terminal 110 is securely held in the first insulation body 101.

Figure 7:
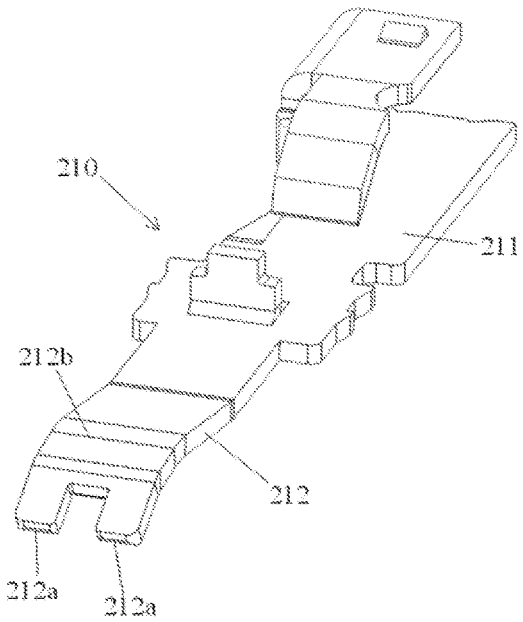
FIG. 7 is a perspective view showing a terminal of the second connector of FIG. 6.

As shown in FIGS. 6 and 7, in an exemplary embodiment of the invention, a second terminal receiving passageway 220 is provided in the second insulation body 201 and receives the cantilever 212 of the second terminal 210. A base 211 of the second terminal 210 is securely held in the second insulation body 201.

As shown in FIGS. 1-2 and 6-8, in an exemplary embodiment of the invention, when the first connector 100 is inserted into the second terminal receiving passageway 220, the cantilever 212 of the second terminal 210 is inserted into the first terminal receiving slot 120 and is pressed by the inner wall 121 of the first terminal receiving slot 120 such that it is elastically deformed. Then, the first connector 100 is inserted into the second terminal receiving passageway 220 of the second connector 200, and the cantilever 212 of the second terminal 210 contacts the cantilever 112 of the first terminal 110 elastically and electrically.

Figure 3:
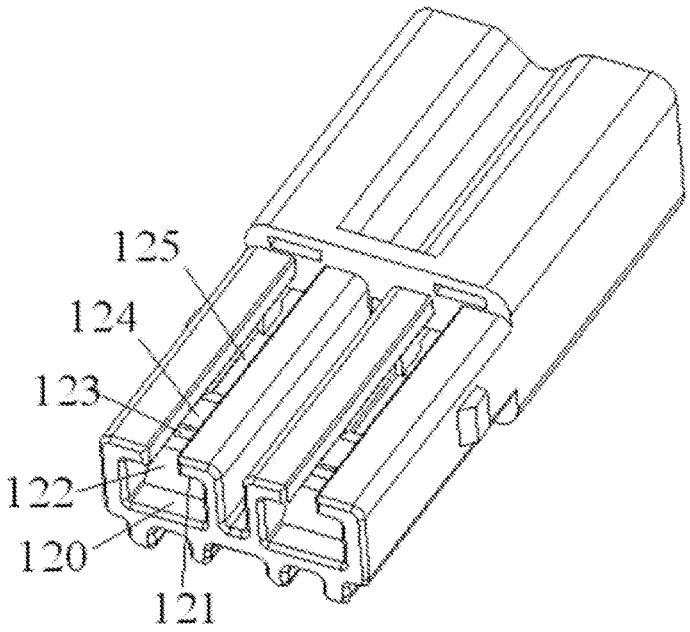
FIG. 3 is a perspective view showing an insulation body of the first connector of FIG. 1.
Figure 4:
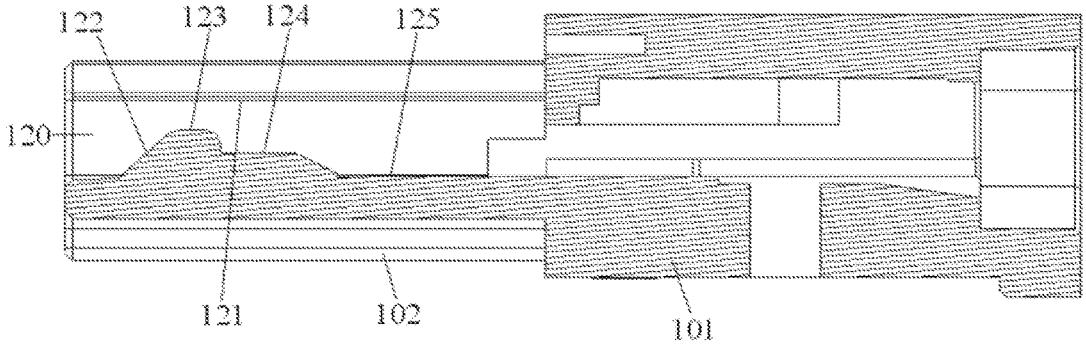
FIG. 4 is a longitudinal sectional view of the insulation body of FIG. 3.
Figure 5:
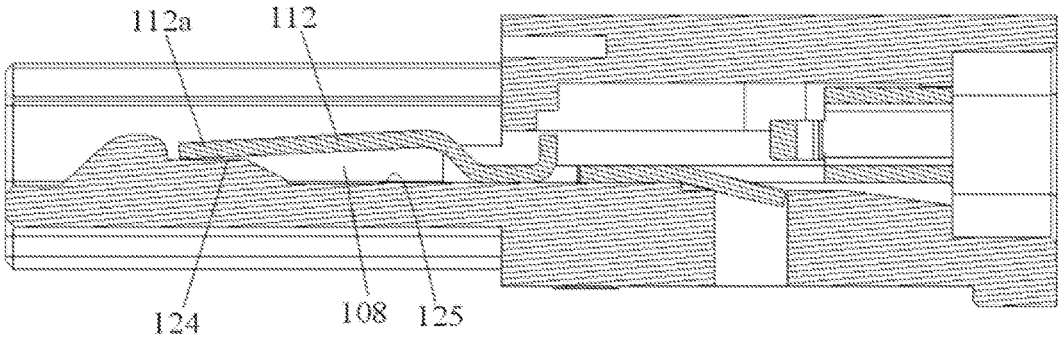
FIG. 5 is a longitudinal section view of the first connector of FIG. 1.

As shown in FIGS. 3-5, in an exemplary embodiment of the invention, the first terminal receiving slot 120 includes a first inner wall 121 and a second inner wall 125 positioned opposite to the first inner wall 121.

Further referring FIGS. 3-5, in an exemplary embodiment of the invention, a projection 123 is formed on the second inner wall 125. The cantilever 212 has a substantial arc shape and includes a free end 212*a* constructed to come in contact with the first inner wall 121, and an electrical contact portion 212*b* constructed to electrically connect to the first terminal 110. A perpendicular distance between the projection 123 of the second inner wall and the first inner wall 121 is designed to be less than the height between the free end (top end) 212*a* of the cantilever 212 of the second terminal 210 and the electrical contact portion 212*b* for contacting the first terminal 110 electrically, such that the cantilever 212 of the second terminal 210 is pressed by a surface of the first inner wall 121 of the first terminal receiving slot 120 and the projection 123 on the second inner wall 125 and deformed elastically during insertion of the cantilever 212 of the second terminal 210 into the first terminal receiving slot 120.

In an exemplary embodiment of the invention, as shown in FIGS. 1-8, during the insertion of the first connector 100 into the second connector 200, the force applied to the cantilever 212 of the second terminal 210 is maximized when the electrical contact portion 212*b* of the cantilever 212 reaches the projection 123 on the second inner wall 125. Once the electrical contact portion 212*b* of the cantilever 212 moves across the projection 123, the force applied to the cantilever 212 of the second terminal 210 will gradually decrease, and the cantilever 212 will be sprung toward the cantilever 112 of the first terminal 110 by the first inner wall 121 and electrically contact the cantilever 112 in the first connector 100.

Further referring FIGS. 3-5 and 8, in an exemplary embodiment of the invention, the projection 123 has a first side facing an opening of the first terminal receiving slot 120 (left side in FIGS. 5 and 8) and a second side positioned opposite to the first side (right side in FIGS. 5 and 8).

As shown in FIGS. 3-5 and 8, an inclined guide 122 is formed at the first side of the projection 123; the cantilever 212 of the second terminal 210 is guided by the inclined guide 122 to smoothly insert into the first terminal receiving slot 120 of the first insulation body 101 of the first connector 100.

As shown in FIGS. 3-5 and 8, a step 124 is formed at the second side of the projection 123, which is located a downstream of an insertion direction of the second connector 200 into the first connector 100, a free end 112*a* of the cantilever 112 is supported on the step 124, such that the cantilever 112 and the surface of the second inner wall 125 are separated by a predefined gap 108. Because of the gap 108 between the cantilever 112 and the surface of the second inner wall 125, the rigidity of the cantilever 112 of the first terminal 110 is prevented from becoming too large.

With the described configuration of the projection 123, the press force applied to the cantilever 212 is maximized during insertion of the first connector 100 into the second connector 200. Since the cantilever 212 of the second terminal 210 is not in contact with the cantilever 112 of the first terminal 110 when the electrical contact portion 212*b* reaches the projection 123, the cantilever 112 of the first terminal 110 is protected from damage.

As shown in FIGS. 1, 3 and 6, in an exemplary embodiment of the invention, a plurality of first terminal receiving slots 120 are formed in the first insulation body 101 to receive a plurality of first terminals 110, and a first alignment slot 102 is formed between two adjacent first terminal receiving slots 120. A plurality of terminal receiving passageways 220 are formed in the second insulation body 201 to receive a plurality of second terminals 210, and a first alignment rib 202 is provided between two adjacent terminal receiving passageways 220. The first alignment rib 202 is engaged with the first alignment slot 102 so as to guide the first connector 100 into the second connector 200 correctly.

Further referring FIGS. 1, 3 and 6, in an exemplary embodiment of the invention, a second alignment slot 103 is provided along a wall (the top wall in FIG. 3) of each first terminal receiving slot 120 of the first connector 100. A second alignment rib 203 is formed on a corresponding wall of each second terminal receiving passageway 220 of the second connector 200. The second alignment rib 203 is engaged with the second alignment slot 103 so as to guide the first connector 100 to insert into the second connector 200 correctly.

In an exemplary embodiment of the invention, the first insulation body 101 is directly formed on the first terminal 110 through an over molding process, and the second insulation body 201 is directly formed on the second terminal 210 also using an over molding process.

In the connector assembly according to various embodiments of the invention, the second cantilever 212 of the terminal 210 of the second connector 200 is pressed by the first insulation body 101 of the second connector 200 and deformed elastically, after the pair of connectors are fitted together, the cantilever 212 of the second terminal 210 elastically and electrically contacts the first terminal 110. In present application, the second terminal 210 is pressed and confined between the first insulation body 101 and the first terminal 110 of the first connector 100, reliably limiting the movement of the second terminal 210. Therefore, even if the relative deformation between the terminals 110, 210 of the pair of connectors 100, 200 is small, a reliable electric connection between the pair of connectors 100, 200 can be guaranteed. Moreover, as the friction factors of the insulation bodies 101, 201 of the connectors 100, 200 are small, the friction force between the terminals 110, 210 and the insulation bodies 101, 201 will also be small, which will not result in an excessive insertion/extraction force. Moreover, the insertion/extraction force may be controlled through a control to the deformation of the second terminal 210 of the second connector 200 relative to the first insulation body 101 of the first connector 100, such that a constant insertion/extraction force is guaranteed.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although exemplary embodiments of the present disclosure is described in detail with reference to the attached drawings, the present disclosure may be embodied in many different forms and should not be construed as being limited to the embodiment set forth herein; rather, these embodiments are provided so that the present disclosure will be thorough and complete.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A connector assembly, comprising:

a first connector having:

a first insulation body having a terminal receiving slot and a projection disposed on a first inner wall of the terminal receiving slot; and a first terminal with a first cantilever secured in the terminal receiving slot; and a second connector connected with the first connector and having:

a second insulation body;

a second terminal secured in the second insulation body; and a second cantilever contacting the projection and positioned between the first insulation body and the first terminal.

2. The connector assembly according to claim 1, wherein the first connector is a male connector.

3. The connector assembly according to claim 2, wherein the second connector is a female connector receiving the first connector.

4. The connector assembly according to claim 1, wherein the second insulation body includes a second terminal receiving passageway receiving the second cantilever.

5. The connector assembly according to claim 4, wherein the second cantilever is pressed by a second inner wall of the terminal receiving slot opposite to the first inner wall when the first connector is inserted into the second terminal receiving passageway.

6. The connector assembly according to claim 4, wherein the second cantilever contacts the first cantilever when the first connector is inserted into the second terminal receiving passageway.

7. The connector assembly according to claim 6, wherein the projection has a first side facing an opening of the terminal receiving slot and a second side opposite to the first side.

8. The connector assembly according to claim 7, further comprising an inclined guide disposed along the first side of the projection.

9. The connector assembly according to claim 8, further comprising a step disposed along the second side of the projection.

10. The connector assembly according to claim 9, wherein a free end of the first cantilever is supported on the step.

11. The connector assembly according to claim 4, further comprising another terminal receiving slot positioned in the first insulation body adjacent the terminal receiving slot to form a pair of terminal receiving slots.

12. The connector assembly according to claim 11, further comprising a first alignment slot positioned between the pair of terminal receiving slots.

13. The connector assembly according to claim 12, further comprising another terminal receiving passageway positioned in the second insulation body adjacent the terminal receiving passageway to form a pair of terminal receiving passageways.

14. The connector assembly according to claim 13, further comprising a first alignment rib positioned between the pair of terminal receiving passageways.

15. The connector assembly according to claim 14, the first alignment rib engages the first alignment slot to guide the first connector into the second connector.

16. A connector assembly, comprising:

a first connector having:

a first insulation body having a pair of terminal receiving slots and a first alignment slot positioned between the pair of terminal receiving slots; and a first terminal with a first cantilever secured in the first insulation body; and a second connector connected with the first connector and having:

a second insulation body;

a second terminal secured in the second insulation body; and a second cantilever positioned between the first insulation body and the first terminal.

17. The connector assembly according to claim 16, wherein the second insulation body includes a second terminal receiving passageway receiving the second cantilever.

18. The connector assembly according to claim 17, further comprising another terminal receiving passageway positioned in the second insulation body adjacent the second terminal receiving passageway to form a pair of terminal receiving passageways.

19. The connector assembly according to claim 18, further comprising a first alignment rib positioned between the pair of terminal receiving passageways.

20. The connector assembly according to claim 19, the first alignment rib engages the first alignment slot to guide the first connector into the second connector.

* * * * *